US011832668B2

(12) United States Patent
Gray

(10) Patent No.: US 11,832,668 B2
(45) Date of Patent: Dec. 5, 2023

(54) HAIR EXTENSIONS, METHODS OF MAKING, AND METHODS OF USING THE SAME

(71) Applicant: Natasha Gray, Cincinnati, OH (US)

(72) Inventor: Natasha Gray, Cincinnati, OH (US)

( * ) Notice: Subject to any disclaimer, the term of this patent is extended or adjusted under 35 U.S.C. 154(b) by 0 days.

(21) Appl. No.: 17/815,312

(22) Filed: Jul. 27, 2022

(65) Prior Publication Data

US 2023/0109742 A1 Apr. 13, 2023

Related U.S. Application Data

(60) Provisional application No. 63/342,722, filed on May 17, 2022, provisional application No. 63/254,400, filed on Oct. 11, 2021.

(51) Int. Cl.
*A41G 5/00* (2006.01)

(52) U.S. Cl.
CPC ..... *A41G 5/0046* (2013.01); *A41G 5/0053* (2013.01)

(58) Field of Classification Search
CPC ..... A41G 5/00; A41G 5/004; A41G 5/0053; A41G 5/0073; A41G 5/0046
See application file for complete search history.

(56) References Cited

U.S. PATENT DOCUMENTS

| | | | |
|---|---|---|---|
| D692,185 | S | 10/2013 | Gray |
| 9,027,568 | B2 | 5/2015 | Lee |
| 9,585,428 | B1 | 3/2017 | Synn et al. |
| D914,989 | S | 3/2021 | Gray |
| D932,706 | S | 10/2021 | Gray |
| 2004/0079382 | A1 | 4/2004 | Profitt-Campbell |

(Continued)

FOREIGN PATENT DOCUMENTS

| | | |
|---|---|---|
| CN | 203943134 | 11/2014 |
| JP | 4883568 | 12/2011 |
| KR | 102066238 | 1/2020 |

OTHER PUBLICATIONS

Innovative Weaves and Wigs, New Thin-Part Wig—No Leave-out—No Lace—Wear your own real part, YouTube video, www.youtube.com/watch?app=desktop&v=X0-x35nkBBc, Jun. 1, 2019.

(Continued)

*Primary Examiner* — Rachel R Steitz
(74) *Attorney, Agent, or Firm* — Barry Choobin; Patent 360

(57) ABSTRACT

A hair extension, method for making a hair extension, and method of using a hair extension is provided that is intended to be less noticeable when worn by a wearer or not easily detectable by others if or when exposed. In one embodiment, a plurality of hairs are attached to a second substrate such that the hair extension is less noticeable while in use. In one example, a weft may be attached to the second substrate to add additional volume and/or length of hair and may be covered by a plurality of hairs extending from the second substrate. In another example, a portion of the hairs attached to the second substrate may be folded over a distal edge of the second substrate to make the hair extension less noticeable. Alternatively, a portion of the hairs attached to the second substrate may be crocheted through a wearer's anchor braid and folded over the hair extension to make the hair extension less noticeable.

20 Claims, 10 Drawing Sheets

(56) References Cited

U.S. PATENT DOCUMENTS

| | | | | |
|---|---|---|---|---|
| 2007/0044814 | A1 | 3/2007 | Beko | |
| 2008/0257369 | A1* | 10/2008 | Poole | A41G 5/004 132/53 |
| 2012/0260933 | A1* | 10/2012 | Ourique | A41G 5/006 132/201 |
| 2015/0013708 | A1 | 1/2015 | Chamberlain | |
| 2015/0034112 | A1 | 2/2015 | Queen | |
| 2016/0174645 | A1* | 6/2016 | Goldner | A41G 5/0073 132/53 |
| 2017/0208884 | A1* | 7/2017 | Alex | A41G 5/0046 |
| 2018/0014593 | A1 | 1/2018 | Suh et al. | |
| 2019/0297977 | A1 | 10/2019 | Kim | |
| 2022/0330637 | A1 | 10/2022 | Gray | |

OTHER PUBLICATIONS

Pure Estrogen, Invisible U-part: No Added Hair "Crochet" Method: $40 Ombre Wig, YouTube video, www.youtube.com/watch?app=desktop&v=awoQdFbnRil, Feb. 18, 2017.

Innovative Weaves and Wigs, Thin Part Wig: How to wear a U Part Wig with 90% less leave-out: Innovative Weaves, YouTube video, www.youbtube.com/watch?app=desktop&v=IUitoKZ0QU4&t=54s, Jan. 20, 2021.

All About Ash, Thin-Part Wig Review: How to Wear a Thin Leave-Out Using No Weft U-Part Wig, YouTube video, www.youtube.com/watch?app=desktop&v=dy-QTxPu6Mo&t=0s, Aug. 17, 2020.

Innovative Weaves and Wigs, Wig Review: Thin Part Wig Negative & Postive Reviews + Innovative Weaves Install Tips, YouTube video, www.youtube.com/watch?app=desktop&v=tPxihcCbfh8&t=1s, Apr. 20, 2021.

ESSNTL, 2 Minute U-Part Wig Install (No Sewing!), YouTube video, www.youtube.com/watch?app=desktop&v=b_93IWOFsL0, Feb. 11, 2018.

Simonesharice, "Upart Wig: Braiding Pattern & Install, Makeup, Coloring Hair & Styling, Julia Hair" YouTube video, https://www.youtube.com/watch?v=DCtX1qbZ5xU, posted Aug. 27, 2020, accessed Nov. 1, 2021.

Simonesharice, "Try This Method to hide the knots on your lace front wig Next Time!!!" YouTube video, https://www.youtube.com/watch?v+laiq9EevuTo, posted Jul. 6, 2020, accessed Nov. 1, 2021.

* cited by examiner

FIG. 11A
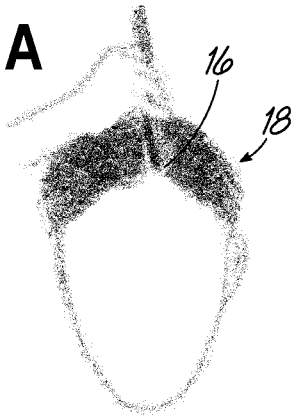
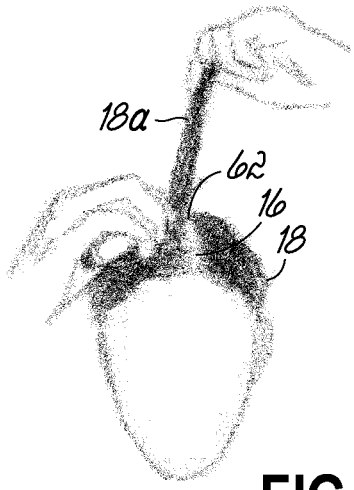
FIG. 11B
FIG. 11C
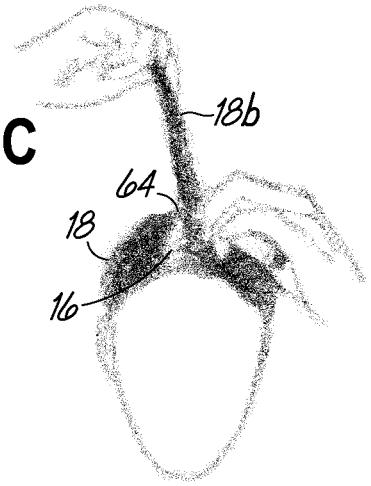
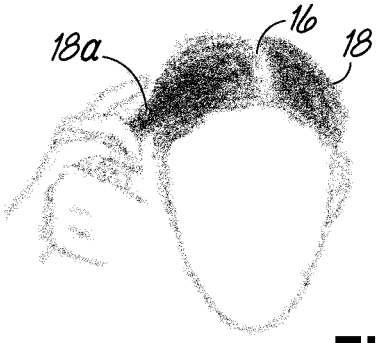
FIG. 11D
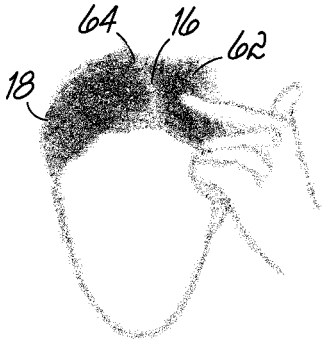
FIG. 11E

HAIR EXTENSIONS, METHODS OF MAKING, AND METHODS OF USING THE SAME

TECHNICAL FIELD

The present invention relates to hair extensions, methods of making, and methods of using the same and, more specifically, to weft hair extensions that can be used, for example, near a part in a wearer's hair without being easily detectable by others, particularly when the hair extension secured adjacent to the part is or becomes exposed.

BACKGROUND

Hair extensions can allow a wearer to add length and/or volume to their natural hair such as by attaching a weft hair extension that contains a plurality of natural or synthetic hairs to the wearer's natural hair. Hair extensions are traditionally attached to a wearer's hair by being sewn in or clipped into the wearer's hair. Depending on the desired final hair style, the wearer may decide to attach the hair extension near a part in the wearer's hair where hair on either side can be brushed or combed in opposite directions to reveal the wearer's scalp. And a leave out portion of hair along the part may be further utilized to help blend or hide the attached hair extension.

With reference to FIG. 1, a conventional hair extension 2 is shown that includes a weft 4 that contains a first plurality of hairs 6, which are sewn onto a first substrate 8 using thread 10. The first substrate 8 has a first substrate thickness and the first plurality of hairs 6 has a hair thickness 14. In many conventional hair extensions 2 that include the weft 4, the first substrate thickness is substantially greater than the hair thickness 14. While using the first substrate 8 allows for a manufacturer to attach a large number of hairs to the weft 4 relatively quickly and without needing to resort to labor intensive crocheting, for example, the resulting bulge arising from the difference in the first substrate thickness and the hair thickness creates an unnatural appearance when visible. This problem is made worse when the first substrate 8 of the weft 4 is attached near a part in the wearer's natural hair because the unnatural appearance caused by the first substrate 8, especially when contrasted with the portion of a wearer's exposed scalp adjacent to the hair part, makes it obvious that the conventional hair extension 2 is not the wearer's natural hair.

If the conventional hair extension 2 including the weft 4 is attached near the hair part, a leave out including a portion of the wearer's natural hair is often used to cover a portion of the weft 4 and avoid the unnatural appearance caused by the first substrate 8. However, if the wind blows or the wearer's natural hair is moved out of place for some other reason, the weft 4 can be revealed to others, allowing observers to clearly see that the wearer is wearing a hair extension. To avoid this unwanted outcome, wearers of conventional hair extensions 2 often decide to, and may need to, use a leave out as described above and blend it into the first plurality of hairs 6 in an effort to make the conventional hair extension 2 less or unnoticeable. However, leave outs can add unwanted time to the overall process. Generally, the larger the leave-out the wearer uses, the more difficult it is for the wearer to blend their natural hair 18 into the first plurality of hairs 6 of the conventional hair extension 2.

Accordingly, there is a need for a hair extension that allows the user to wear a thin(ner) leave out or no leave out at all while enabling the hair extension to be less readily or undetectable to observers if, for example, the location where the hair extension is attached at or near a part becomes exposed.

SUMMARY OF THE INVENTION

The present invention is directed to hair extensions, methods of making, and methods of using the same and, more specifically, to weft hair extensions that can be used, for example, near a part in a wearer's hair without being easily detectable by others, particularly when the hair extension secured adjacent to the part is or becomes exposed.

In one embodiment, a hair extension is provided that includes a first weft including a first substrate and a first plurality of hairs. The first substrate has a length, width, and thickness and includes a top side, a bottom side opposite the top side, and an edge along the length of the first substrate. The first plurality of hairs have a desired length and extend from the top side, wherein the bottom side is situated proximate a wearer's hair when the hair extension is attached to the wearer's hair. The hair extension further includes a second substrate having a length, width, and thickness and includes a top side and a bottom side opposite the top side. The second substrate is attached to the first substrate at or along the edge of the first substrate so that the second substrate extends in a direction generally opposite to the first substrate. The bottom side of the second substrate is situated proximate the wearer's hair when the hair extension is attached to the wearer's hair. The extension also includes a second plurality of hairs having a desired length and extending from the top side of the second substrate.

In another embodiment, a hair extension is provided that includes a substrate having a length, width, and thickness and includes a top side and a bottom side opposite the top side. The substrate has a plurality of hairs having a desired length and extending from the top side of the second substrate. The substrate includes lace with a plurality of openings or a polyurethane sheet, wherein the thickness of the substrate is from about 0.15 mm to about 0.45 mm. The hair extension further includes an attachment device secured to the bottom side of the substrate and that attaches the hair extension to a wearer's hair such that the bottom side of the substrate is situated proximate the wearer's hair when the hair extension is attached thereto. The attachment device is a hair clip or comb and the hair extension is devoid of a weft.

In another embodiment, a method of installing a hair extension on a head of a wearer includes preparing a part in the wearer's hair, and preparing a first anchor from a portion of the wearer's hair to receive the hair extension on a first side of the wearer's part, wherein the first anchor is a tangle of teased hair, an anchor braid, hair roots, or a combination thereof. The method further includes installing the hair extension to the head of the wearer by securing the hair extension to the first anchor. The hair extension can include, for example, a first weft including a first substrate and a first plurality of hairs. The first substrate has a length, width, and thickness and includes a top side, a bottom side opposite the top side, and an edge along the length of the first substrate. The first plurality of hairs has a desired length and extends from the top side, wherein the bottom side is situated proximate a wearer's hair when the hair extension is attached to the wearer's hair. The hair extension further includes a second substrate having a length, width, and thickness and includes a top side and a bottom side opposite the top side. The second substrate is attached to the first substrate at or along the edge of the first substrate so that the second substrate extends in a direction generally opposite to the first substrate The bottom side of the second substrate is situated proximate the wearer's hair when the hair extension is attached to the wearer's hair. The hair extension further includes a second plurality of hairs having a desired length and extends from the top side of the second substrate.

BRIEF DESCRIPTION OF THE DRAWINGS

The accompanying drawings, which are incorporated in and constitute a part of this specification, illustrate embodiments of the invention and, with a detailed description of the embodiments given below, serve to explain the principles of the invention. The components in the figures are not necessarily to scale. Moreover, in the figures, like-referenced numerals designate corresponding parts throughout the different views.

FIGS. 11A-11E are front views of a wearer preparing a part for receiving the hair extension of FIG. 6 in accordance with an embodiment of the invention;

DETAILED DESCRIPTION

Figure 1:
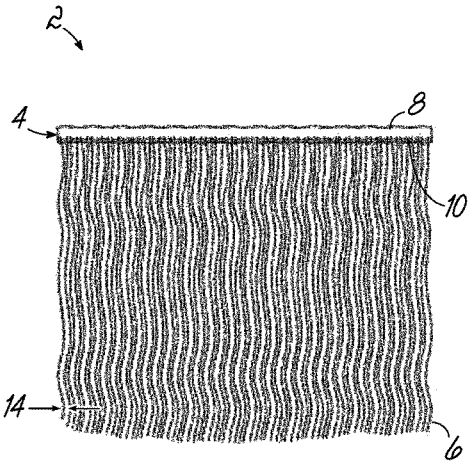
FIG. 1 PRIOR ART
FIG. 1 is a front elevational view of a traditional weft hair extension.

Any numerical ranges specified throughout the specification can include the endpoints of the range unless otherwise indicated. Furthermore, the ranges can include all values between the endpoints of the ranges unless otherwise indicated.

As shown in FIGS. 2-7, a hair extension 20 includes a second substrate 22 that is attached to a weft 4 via a first substrate 8 that contains a first plurality of hairs 6 extending in a direction away therefrom. The second substrate 22 has a second substrate top side 24 and a second substrate bottom side 26 opposite the second substrate top side 24. The first substrate 8 has a first substrate top side 28 and a first substrate bottom side 30.

Figure 2:
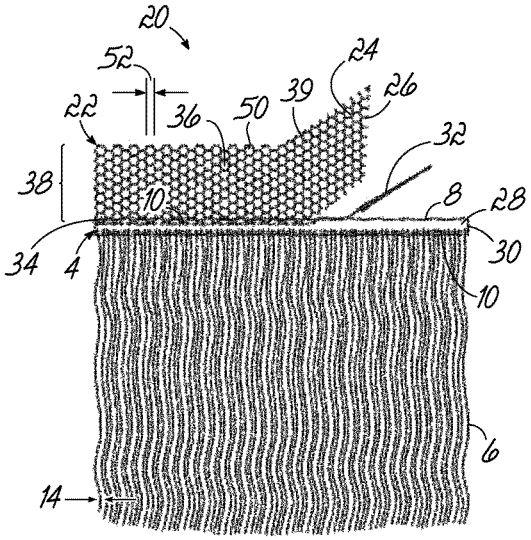
FIG. 2 is a front elevational view of a second substrate being attached to a first substrate of a weft hair extension in accordance with an embodiment of the invention.
Figure 3:
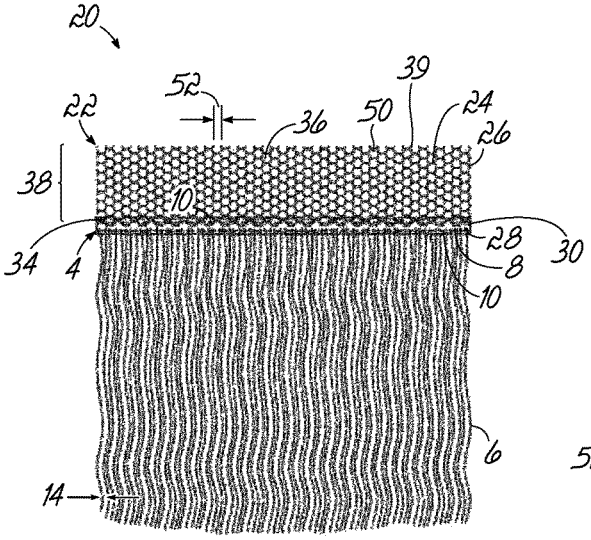
FIG. 3 is a front elevational view of the hair extension of FIG. 2 with the second substrate fully attached.

As best shown in FIGS. 2 and 3, in one example, a length of the second substrate 22 can be attached to the first substrate 8 generally along its length and adjacent an edge thereof. One method for attaching the second substrate 22 to the first substrate 8 is hand sewing the two together using a needle 32 and a thread 10 such that one end of the second substrate 22 is stitched along its length to one end of the first substrate 8 thereby defining a first overlap 34. While shown as being attached along the edge of the first substrate top side 28, it should be understood that the second substrate 22 can be secured away from the edge and/or to the first substrate bottom side 30, for example. Also, the second substrate 22 may be secured at desired areas or intervals along its length as compared to substantially along the entirety of its length. In addition, alternative methods for joining together the second substrate 22 and the first substrate 8 may be used, such as bonding together with an adhesive, mechanical sewing, using a mechanical fastener (e.g., a clip, button(s), Velcro, and the like), welding, magnets, any other conventional joining technique, and any combination thereof. The second substrate 22, which is attached to the weft 4 via the first substrate 8, extends away from or in a direction generally opposite from the first substrate 8 and the first plurality of hairs 6 to define an overhang portion 36. The second substrate 22 further includes a width 38 defined as the distance between the first overlap 34 and a distal edge 39. In one embodiment, the width 38 is from about 0.1 mm to about 204 mm. In another embodiment, the width 38 is from about 0.1 mm to about 102 mm. In yet another embodiment, the width 38 is from about 102 mm to about 204 mm. The first substrate 8 also includes a width, which is from about 1 mm to about 153 mm. In another embodiment, the width is from about 1 mm to about 10 mm. In yet another embodiment, the width 38 is from about 10 mm to about 153 mm.

With further reference to FIG. 3, the length of the hair extension 20 can be from about 0.5 inches to about 10 ft. If the hair extension 20 has a longer length than desired by the wearer, the wearer can cut the hair extension 20 to the length desired or can cut an opening or slit 60 therein (See FIGS. 10A and 10B) such as to bend the hair extension 20 as described further below. In one embodiment, the length of the hair extension 20 can be from about 10 inches to about 10 ft. In another embodiment, the length of the hair extension 20 can be from about 0.5 inches to about 10 inches. In yet another embodiment of the invention, the length of the hair extension 20 can be from about 1 inch to about 5 inches. The length of the hair extension 20 also can define the length of the first substrate 8, the second substrate 22, and/or the first overlap 34. As shown in the embodiment of FIG. 3, the length of the hair extension 20 defines the length of the first substrate 8, the length of the second substrate 22, and the length of the first overlap 34. In this embodiment, the first overlap 34 completely covers (i.e., extends along the length of) the first substrate top side 28 and the bottom side 26 of the second substrate 22. In a further embodiment, where the length of the first substrate 8 is larger than the length of the second substrate 22 (not shown), the length of the hair extension 20 defines the length of the first substrate 8 and the length of the second substrate 22 defines the length of the first overlap 34. In another further embodiment, where the length of the second substrate 22 is longer than the length of the first substrate 8 (not shown), the length of the hair extension 20 defines the length of the second substrate 22 and the length of the first substrate 8 defines the length of the first overlap 34. Although the first substrate 8 and the second substrate 22, as shown in FIG. 3, may each have a uniform length and a uniform width and a linear first overlap 34, it should be understood that the length and/or width may be non-uniform therealong, which can provide for a non-linear first overlap. Such non-uniform length and/or width can allow for any of a variety of shapes and configurations for the first and second substrates 8, 22.

The first substrate 8 and/or second substrate 22 can include or can be a textile material (e.g., a knit, woven, or nonwoven textile) that may be made of natural and/or synthetic fibers and/or yarns, including blends thereof. In one example, the textile material can include, for example, nylon, satin, silk, cotton, polyester, polyurethane, synthetic sheets, and the like, or combinations thereof. In one embodiment, the material for the first substrate 8 and/or second substrate 22 is selected for its high durability such as to avoid being easily ripped or torn with repeated use. As shown, the first substrate 8 and/or second substrate 22 can include a lace that defines a woven (or mesh-like) material. In another embodiment, the second substrate 22 can include a lace that defines a knitted structure or a fused fabric material (e.g., a nonwoven material).

In one embodiment, the first substrate 8 and/or second substrate 22 may be reinforced using an additional structure (not shown). This additional reinforcing structure, for example, may comprise additional layers of the first substrate 8 and/or the second substrate 22, which can be attached/secured to each other by means and methods known in the art. In one embodiment, the hair extension 20 may include from 1 to 14 layers of the first substrate 8 and/or the second substrate 22. In another embodiment, the hair extension 20 may include from 1 to 2 layers of the first substrate 8 and/or the second substrate 22. The first substrate 8 can have a first substrate thickness 12 from about 0.25 mm to about 25 mm (See, e.g., FIG. 7). In another embodiment, the first substrate 8 can have a first substrate thickness 12 from about 0.5 to about 4 mm. In yet another embodiment, the first substrate 8 can have a first substrate thickness 12 from about 1 mm to about 2.2 mm. The second substrate 22 can have a second substrate thickness 48 from about 0.15 mm to about 26 mm (See, e.g., FIG. 7). In another embodiment, the second substrate thickness 48 may be from about 0.45 mm to about 26 mm. In yet another embodiment, the second substrate thickness 48 may be from about 0.15 mm to about 0.45 mm.

In one embodiment, the first substrate 8 and/or second substrate 22 is formed to define a woven or mesh/mesh-like structure, such as via molding techniques (e.g., injection molding), 3D printing, and the like. As shown, the second substrate 22 also has a plurality of openings 50 (See, e.g., FIGS. 4 and 5) such that each of the plurality of openings 50 has an opening width 52. In one embodiment, the opening width 52 can be from about 0.1 mm to 26 mm. In another embodiment, the opening width 52 can be from about 1.5 mm to about 26 mm. In yet another embodiment, the opening width 52 is from about 0.1 mm to about 1.5 mm. While the openings 50 are shown here as having a generally hexagonal shape, it should be understood that the openings 50 are not so limited and may include other or a combination of shapes (and sizes) including, for example, circular, triangular, square, and the like.

The color of the first substrate 8 and/or the second substrate 22 may be selected based on at least one of several criteria. In one embodiment, the color of the first substrate 8 and/or the second substrate 22 is selected to match the color of the first plurality of hairs 6 or the wearer's hair color. In another embodiment, the color of the second substrate 22 and/or the first substrate 8 may be selected to correspond to a root color of the wearer's natural hair 18, or a color of the first plurality of hairs 6. In one example, the color selected can be black, jet black, natural black, and the like. In one example, the first substrate 8 and/or second substrate 22 includes a textile material that has or is provided with a black, jet black, natural black, or any similar dark color, which can correspond with the color of the first plurality of hairs 6 or the wearer's hair color, for example. In another example, the first substrate 8 and/or second substrate 22 includes a synthetic material, such as polyurethane, that has or is provided with a black, jet black, natural black, or any similar dark color, which can correspond with the color of the first plurality of hairs 6 or the wearer's hair color, for example. In yet another embodiment, the color of the first substrate 8 and/or the second substrate 22 may be selected to be less noticeable whether or not hair is attached. In one example, the first substrate 8 and/or the second substrate 22 includes a textile material that is clear and transparent. In another example, the first substrate 8 and/or second substrate 22 includes a synthetic material, such as polyurethane, that is clear and transparent. It should be understood that other/any number of specific colors may be contemplated as well.

Figure 4:
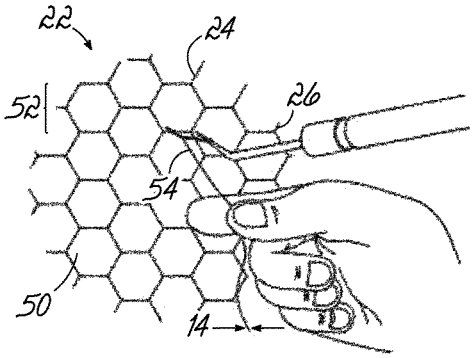
FIG. 4 is a front view of a hair(s) being attached to a portion of the second substrate of the hair extension of FIG. 3 in accordance with an embodiment of the invention.
Figure 5:
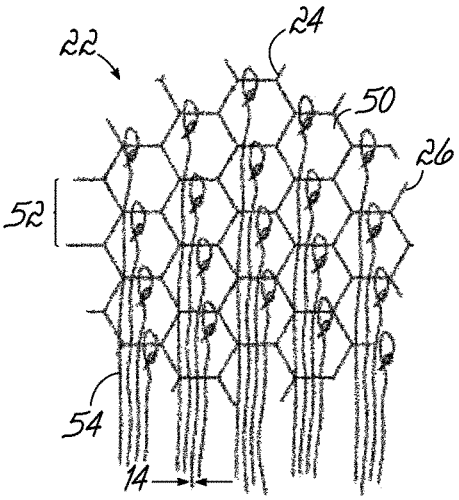
FIG. 5 is a front elevational view of a portion of the second substrate of FIG. 4 with a plurality of hairs attached.

As shown in FIGS. 4-7, a second plurality of hairs 54 may be attached directly (e.g., hand tied) to the second substrate 22. As best shown in FIGS. 4 and 5, the second plurality of hairs 54 may be attached to the second substrate 22 by inserting individual hairs through a corresponding opening 50 and securing those individual hairs to the second substrate 22 using a method including, for example, hand tying, crocheting, ventilating, machine insertion, or other similar methods. Hand tying/crocheting/ventilating can include a labor-intensive process of attaching individual human or synthetic hairs to the second substrate 22, such as by passing a specialized wig crochet hook through the opening 50, pulling the human hair through therethrough and knotting the hair to the second substrate 22. Machine insertion or injection can involve repeatedly mechanically puncturing of the second substrate 22 with a needle containing at least one of the second plurality of hairs 54, and is described in greater below with respect to FIG. 5A. In one example, machine insertion can be used to attach the second plurality of hairs 54 to the second substrate 22, which can include a synthetic material or sheet of material, such as a polyurethane sheet. The second plurality of hairs 54 may be attached to one or more sides of the second substrate 22. For example, in one embodiment, the hair extension 20 can include a second substrate 22 that has the second plurality of hairs 54 attached to the second substrate top side 24. Attaching the second plurality of hairs 54 to the second substrate 22 can allow the second plurality of hairs 54 to hide the first substrate 8 or make the first substrate 8 less visible when the hair extension 20 is viewed from that side. Concerning the first plurality of hairs 6 and the first substrate 8, while the first plurality of hairs 6 conventionally are sewn onto the first substrate 8 using thread 10, in one embodiment, the first plurality of hairs 6 similarly may be attached directly to the first substrate 8, like as discussed with respect to the second substrate 22 herein, such as by using a method including, for example, hand tying, crocheting, ventilating, machine insertion, or other similar methods.

Figure 5A:
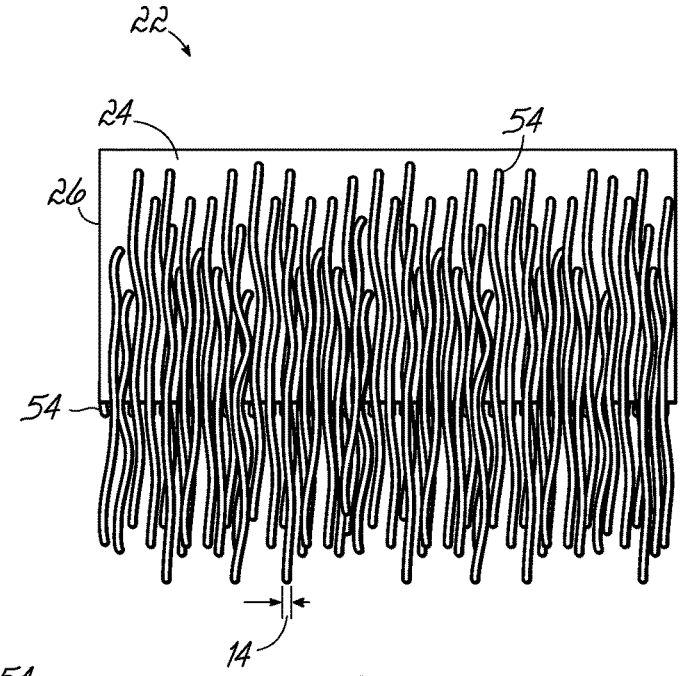
FIG. 5A is a front elevational view of a variation of the second substrate of FIG. 5 with a plurality of hairs attached in accordance with another embodiment of the invention.

With specific reference to FIG. 5A and concerning machine insertion techniques, when a machine needle, for example, is inserted and removed from the second substrate 22, the one of the second plurality of hairs 54 has been injected into and through the second substrate 22 and remains attached to the second substrate 22 whereby a small portion or end of the second plurality of hairs 54 can extend out from the opposite side of the second substrate 22. Here, the second plurality of hairs 54 have been injected or inserted into the second substrate 22, which can include a synthetic sheet (e.g., a polyurethane sheet), such that the second plurality of hairs 54 extend primarily from the second substrate top side 24 with a portion situated through the second substrate 22 and extending from the second substrate bottom side 26. In such an embodiment, the portion of the plurality of hairs 54 that extends from the second substrate bottom side 26 may be attached/secured to the second substrate 22 using means and methods known in the art, such as bonding with an adhesive or attaching another second substrate 22 thereover, such as adhesively. While the second substrate(s) 22, for example, is shown visible through the second plurality of hairs 54 in FIG. 5A, it should be understood that this is done for illustrative purposes to show that which would be hidden otherwise by the second plurality of hairs 54. That is, the hair extension 20, in one example, includes a sufficient number or amount of the second plurality of hairs 54 to cover or hide the second substrate 22.

With continuing reference to FIGS. 2-7, the characteristics of the first and second plurality of hairs 6 and 54 may be selected based on at least one of several considerations. For example, the first and second plurality of hairs 6, 54 may include the same or different types of hair such as natural hair, synthetic hair, other suitable hair replacements, or a combination thereof. The first and second plurality of hairs 6, 54 may also have the same or different characteristics such as straight, wavy, curly, frizzy, kinky, other suitable hair types, or combinations thereof. The color of the second plurality of hairs 54 may be selected, for example, to correspond with the color of the second substrate 22, the color of the first plurality of hairs 6, or the color of the wearer's natural hair 18. In one embodiment, the color of the first and second plurality of hairs 6,54 may be selected to correspond to a root color of the wearer's natural hair 18, or a color of the first plurality of hairs 6. In one example, the color selected can be black, jet black, natural black, and the like. In one embodiment, the second plurality of hairs 54 includes hair with different characteristics that are attached to different portions of the second substrate 22. In one embodiment, some of the second plurality of hairs 54 attached to the second substrate 22 are frizzy, kinky, curly, or are processed in some other similar style while other portions of the second plurality of hairs 54 have a different style. For example, the second plurality of hairs 54 proximate to the distal edge 39 may be frizzy, kinky, or curly to obscure the distal edge 39 while other portions of the second plurality of hairs 54 have the characteristics of the desired hairstyle. The length of the first and second plurality of hairs 6, 54 can be of any desired size. In one example, the length can be from about 1 inch to about 60 inches. In another example, the length can be from about 4 inches to about 40 inches.

Figure 6:
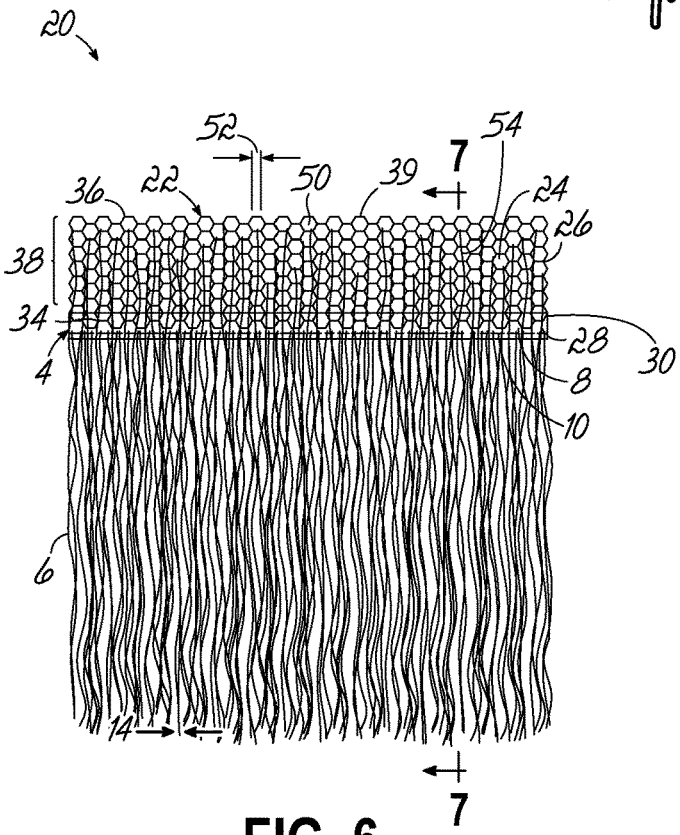
FIG. 6 is a front elevational view of the hair extension of FIG. 3 with the plurality of hairs attached to the second substrate in accordance with an embodiment of the invention.
Figure 7:
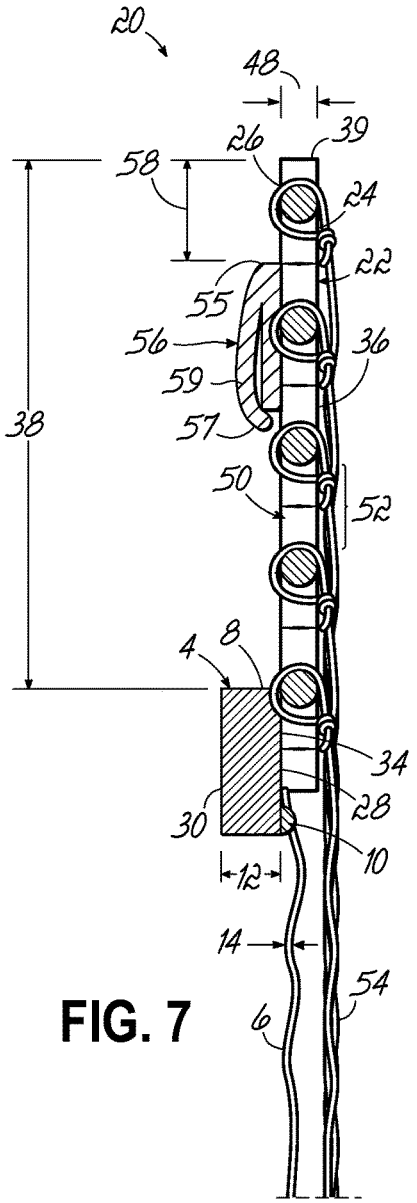
FIG. 7 is a cross-sectional view of the hair extension of FIG. 6 taken along lines 7-7 with an attachment device in accordance with an embodiment of the invention.

As best shown in FIGS. 6 and 7, the hair extension 20 includes the weft 4 having the first substrate 8 and first plurality of hairs 6 and its attached second substrate 22 with the second plurality of hairs 54. While the first and second substrates 8, 22, for example, are visible through the first and second plurality of hairs 6, 54 in FIG. 6 (as well as in other Figures), it should be understood that that is done for illustrative purposes to show that which would be hidden otherwise by the first and second plurality of hairs 6, 54, in the various embodiments. While the second substrate 22 is shown to be attached to the weft 4 via the first substrate top side 28 generally along its length and adjacent an edge thereof, it should be understood that the hair extension 20 may include one or more second substrates 22 attached to one or both sides of the weft 4 or to multiple wefts 4 as described in greater detail below (see FIGS. 8A-8C). Similarly, while the second plurality of hairs 54 is shown to extend from the second substrate top side 24, the second plurality of hairs 54 may be attached to the other side of the second substrate 22 or both sides of the second substrate 22 (See, e.g., FIG. 20). It should be further understood that the hair extension 20 also may exclude the second plurality of hairs 54 from the second substrate 22 (See, e.g., FIG. 3). In such an embodiment, the second plurality of hairs 54 may be later attached by the wearer or some other third party (e.g., a hair stylist).

Figure 7A:
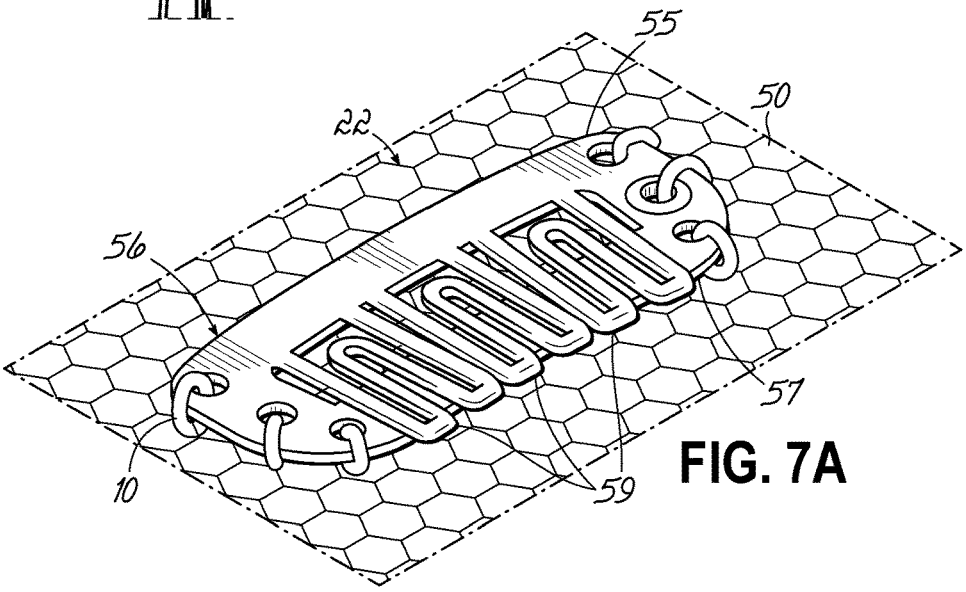
FIG. 7A is a perspective view of the hair extension clip of FIG. 7 as used with the hair extension in accordance with an embodiment of the invention.

With continuing reference to FIGS. 7 and 7A, the hair extension 20 can further include at least one attachment device 56, which is shown here as a hair extension clip, which can be a conventional clip, to attach the hair extension 20 to the wearer, e.g., the wearer's natural hair 18. As best shown in FIG. 7A, the hair extension clip 56 can include a first end 55 and a second end 57. The first end 55 of each hair extension clip 56 can be attached to the second substrate 22 proximate to the distal edge 39. The hair extension clip(s) 56 can include a plurality of hair-engaging teeth 59, which can define spring-loaded teeth, as is known in the art, to attach to the wearer's natural hair 18 when the wearer is wearing the hair extension 20. The hair-engaging teeth 59 can extend from the clip 56 in a direction away from the first end 55 and towards the second end 57. The second end 57 of the hair extension clip 56 is disposed farther from the distal edge 39 than the first end 55. Other suitable attachment devices 56 may be used instead of or in addition to the hair extension clip 56 such as, for example, wig comb(s), sewing thread, bobby pin(s), adhesive (e.g., glue), tape, magnet(s), other suitable methods for attaching a hair extension to a wearer or the wearer's natural hair, or combinations thereof as discussed further below. The attachment device 56 may be attached to the hair extension 20 using any suitable method for joining two materials together including, for example, sewing, bonding with an adhesive (e.g., glue), taping, and the like, or any combination thereof. In one example, the hair extension clip 56 can be attached to the second substrate 22 and/or the first substrate 8 by an adhesive or by sewn threads. As shown in FIG. 7A, the attachment device 56 can be attached to the second substrate 22 by threads 10. In another embodiment, the attachment device 56 can be attached to the second substrate 22, e.g., a synthetic sheet, using an adhesive (not shown). In another embodiment, the attachment device 56 can be sewn onto a separate textile material or another substrate (like the second substrate 22), for example, that then can be attached to the second substrate 22, such as using an adhesive and the like.

The attachment device 56 may be attached to a desired location on the first substrate 8 and/or second substrate 22 of the hair extension 20 or any other suitable area of the hair extension 20. In one embodiment, the attachment device 56 may be attached to the hair extension 20 proximate the distal edge 39 of the second substrate 22 such that the distance between the attachment device 56 and the distal edge 39 defines a separation distance 58. In one embodiment, the separation distance 58 can be from 0.05 mm to 76 mm. In another embodiment, the separation distance 58 can be from 4 mm to 76 mm. In yet another embodiment, the separation distance 56 can be from 0.05 mm to 4 mm. In other embodiments, the attachment device 56 is not attached to the hair extension 20 by the manufacturer (see FIG. 6). In such embodiments, the attachment device 56 may be attached to the device by the wearer or some other person, such as a hair stylist, for example. The number of attachments devices 56 can vary, as needed/desired, to adequately secure the hair extension 20 to the wearer, as would be understood by one skilled in the art.

In embodiments where the attachment device 56 includes a hair extension clip, a number of the second plurality of hairs 54, such as proximate to the distal edge 39, may be folded over the distal edge 39 and attached to the second substrate bottom side 26 or attached to the first substrate bottom side 30 (see FIGS. 17-19), which is described in greater detail below.

In embodiments where the attachment device 56 includes a wig comb, the wig comb may include a plurality of teeth that engage with a portion of the wearer's natural hair 18 to prevent movement of the hair extension 20 (not shown). Such wig comb(s) may include any wig comb(s) conventionally used to attach a wig or hair extension 20 to the wearer's natural hair 18. In one example, each of the plurality of teeth may form a substantially oval shaped with pointed ends. Similar to the hair extension clips, the wig comb(s) may be attached to the hair extension 20 adjacent to or proximate the distal edge 39. And the wig comb(s) may come in contact with the wearer's natural hair 18 at or proximate a tangle, an anchor braid, other suitable attachment points (e.g., hair roots), or combinations thereof.

In embodiments where the attachment device 56 includes an attachment thread sewn into the hair extension 20 and the wearer's natural hair 18, the sewing method may involve, for example, a running stitch, a basting stitch, a cross stitch, a back stitch, any other suitable stitching technique, or any combination thereof. In one embodiment, the back stitch is preferable because it renders the attachment thread less detectable because the attachment thread is only visible from a line of dots that blend in with the wearer's natural hair 18 better than loops or wider threading.

In embodiments where the attachment device 56 can include at least one bobby pin, a bent portion of the bobby pin(s) may come in contact with the hair extension 20 proximate the distal edge 39, with a top portion of the bobby pin(s) coming in contact with the second substrate top side 24 and a bottom portion of the bobby pin(s) coming in contact with the wearer's natural hair 18 (not shown). In a further embodiment, the bottom portion of the bobby pin(s) can puncture or pierce through the second substrate 22. In another embodiment, the bent portion of the bobby pin(s) may come into contact with the hair extension 20 proximate the distal edge 39, with the top portion and the bottom portion of the bobby pin(s) coming in contact with the wearer's natural hair 18. In a further embodiment, the top portion and bottom portion of the bobby pin(s) can puncture or pierce the second substrate 22 to help secure the hair extension 20. The bobby pin(s) may come in contact with the wearer's natural hair 18 at or proximate a tangle, an anchor braid, other suitable attachment points, or combinations thereof (not shown).

In embodiments where the attachment device 56 is secured via an adhesive, the adhesive may include, for example, conventional "tape-in-extensions," glue, tape, and the like. The adhesives, in one example, can include cyanoacrylate adhesives, polyurethane adhesives, urethane adhesives, and epoxy adhesives. In embodiments where the attachment device 56 includes magnets, a first magnet can be attached to the second substrate bottom side 26 or the first substrate bottom side 30 using a conventional means of joining two materials including, for example, bonding with an adhesive (e.g., glue or tape), using a mechanical fastener, other suitable joining techniques, or combination thereof. In such embodiments, a second magnet may be used together with the first magnet to attach the hair extension 20 to the wearer's natural hair 18 by trapping a portion of the wearer's natural hair 18 between the first magnet and the second magnet (not shown).

Figure 8D:
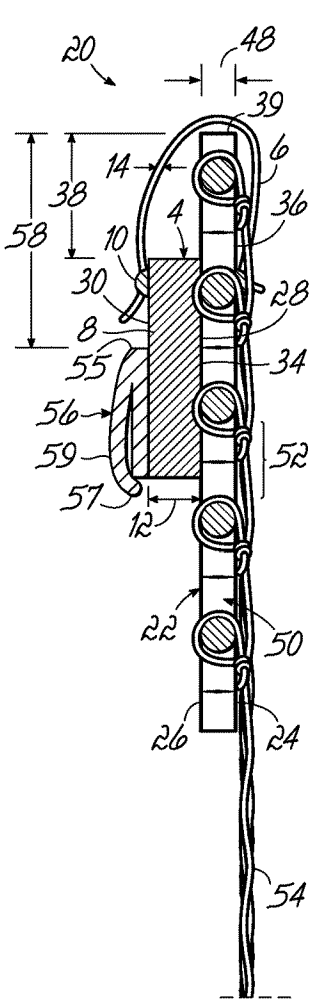
FIG. 8D is a cross-sectional view of another variation of the hair extension of FIG. 7 with a weft attached in a 180° fashion and situated proximate the distal edge of the second substrate in accordance with another embodiment of the invention.
Figure 8C:
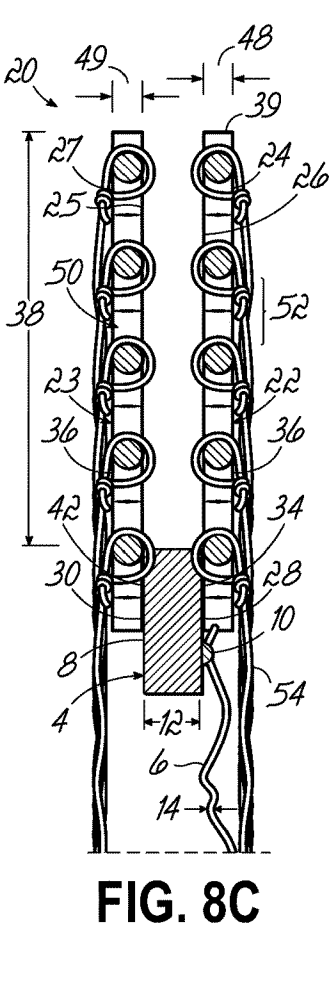
FIG. 8C is a cross-sectional view of another variation of the hair extension of FIG. 7 with separate second substrates individually attached to opposite sides of the first substrate in accordance with another embodiment of the invention.
Figure 8B:
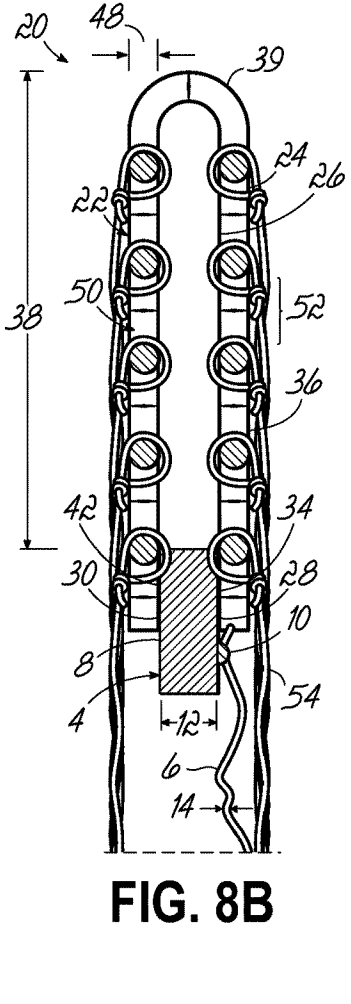
FIG. 8B is a cross-sectional view of another variation of the hair extension of FIG. 7 with a second substrate attached on both sides of the weft in accordance with another embodiment of the invention.
Figure 8A:
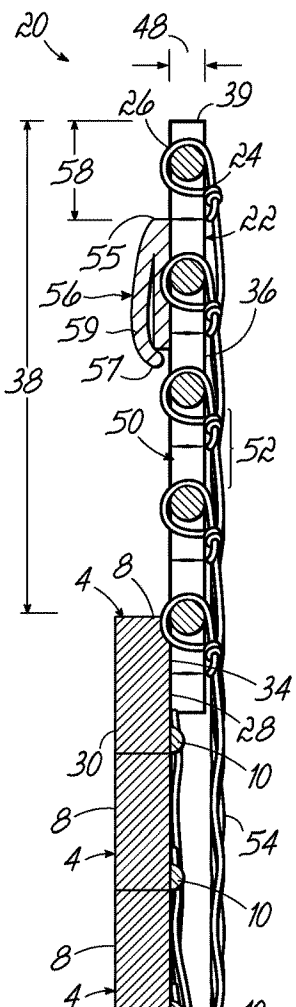
FIG. 8A is a cross-sectional view of a variation of the hair extension of FIG. 7 including a plurality of wefts in accordance with another embodiment of the invention.

As shown now in FIG. 8A, the hair extension 20 is a variation of the hair extension 20 of FIG. 7 and includes a plurality of wefts 4 that securely cooperate with the second substrate 22 whereby the second substrate 22 can be stitched to the first substrate 8 of the top or uppermost weft 4, like as shown and described above in FIGS. 2-7. While the second substrate 22 is shown to be attached to the front side of the topmost weft 4 of the plurality of wefts 4, it is understood that other embodiments of the invention may include one or more second substrates 22 attached to one or both sides of one or more of the plurality of wefts 4 as described in further detail below. Similarly, while the second plurality of hairs 54 is shown to extend from the second substrate top side 24, other embodiments of the invention may attach a plurality of hairs to the other side of the second substrate 22, both sides of the second substrate 22, or neither side of the second substrate 22. The hair extension 20 further includes at least one attachment device 56 used to attach the hair extension 20 to the wearer, e.g., the wearer's natural hair 18. As shown in FIG. 8A, the attachment device 56 is a hair extension clip. Other suitable attachment devices 56 may be used instead of or in addition to the hair extension clip such as, for example, sewing thread, bobby pin(s), adhesive (e.g., glue), tape, magnets, other suitable methods for attaching a hair extension to a wearer or the wearer's natural hair, or combinations thereof. The attachment device 56 may be attached to the hair extension 20 using any suitable method for joining two materials together including, for example, sewing, bonding with an adhesive (e.g., glue), taping, and the like, or any combination thereof. The attachment device 56 may be attached to the hair extension 20 at a desired location on the first substrate 8 and/or second substrate 22 of the second substrate 22 or any other suitable portion of the hair extension 20. In one embodiment, the attachment device 56 may be attached to the hair extension 20 proximate the distal edge 39 of the second substrate 22 such that the distance between the attachment device 56 and the distal edge 39 defines the separation distance 58.

With reference now to FIG. 8B, the hair extension 20 shown is another variation of the hair extension 20 of FIG. 7 in which a single second substrate 22 is attached to both sides 28, 30 of the first substrate 8. In particular, a second overlap 42 is formed by folding the second substrate 22 around or over the top edge of the first substrate 8 such that the second substrate bottom side 26 and the first substrate top side 28 come into contact and a length of each of the second substrate 22 and first substrate 8 is stitched together, like as shown and described above with respect to the first overlap in FIGS. 2-7. In one embodiment, the attachment device 56, e.g., a hair extension clip, may be secured (not shown), in a manner as is shown and described above in FIGS. 7 and 7A, to the top side 24 of the second substrate 22 proximate to the distal edge 39 and, in one example, on top of the second plurality of hairs 54, such that the plurality of hair-engaging teeth 59 would extend in a direction away from the distal edge 39 of the second substrate 22. In another embodiment, the hair extension 20 of FIG. 8B may be secured, such as via thread, to the wearers hair 18 by methods known in the art (e.g., sewing/stitching methods).

With reference now to FIG. 8C, the hair extension shown is another variation of the hair extension 20 of FIG. 7 in which a plurality of substrates, which includes the second substrate 22 and a third substrate 23, may be individually attached to opposite or both sides 28, 30 of the first substrate 8, like as shown and described above in FIGS. 2-7. In such an embodiment, the third substrate 23 may include materials and attachments like as shown and described above for second substrate 22. As shown, like the second substrate 22, the third substrate 23 has a third substrate thickness 49 between a third substrate top side 25 and a third substrate bottom side 27. In such an embodiment, the second substrate bottom side 26 may come in contact with the first substrate top side 28 to form the first overlap 34 and the third substrate top side 25 may come in contact with the first substrate bottom side 30 to form the second overlap 42. Moreover, in one embodiment, the attachment device 56, e.g., a hair extension clip, may be secured (not shown), in a manner as is shown and described above in FIGS. 7 and 7A, to the bottom side 27 of the third substrate 23 proximate to the distal edge 39 and, in one example, on top of the second plurality of hairs 54. In another embodiment, the hair extension 20 of FIG. 8C may be secured, such as via thread, to the wearers hair 18 by methods known in the art (e.g., sewing/stitching methods). Although the third substrate 23 may have a uniform length and a uniform width and a liner second overlap 42, it should be understood that the length and/or width may be non-uniform therealong, which can provide for a non-linear first overlap. Such non-uniform length and/or width can allow for any of a variety of shapes and configurations for the third substrate 23.

With reference now to FIG. 8D, the hair extension 20 shown is another variation of the hair extension 20 of FIG. 7 in which the weft 4 is attached to the second substrate bottom side 26 in a 180° fashion and situated proximate the distal edge 39 of the second substrate 22. The weft 4 is attached via the first substrate top side 28 to the second substrate bottom side 26, like as shown and described above in FIGS. 2-7, such that the first plurality of hairs 6 extends in a direction generally opposite from the direction in which the second plurality of hairs 54 extends. As shown, the first plurality of hairs 6 is folded over and around the distal edge 39 of the second substrate 22 such that a portion of the first plurality of hairs 6 that is folded over the second substrate 22 extends in a direction generally parallel with the second plurality of hairs 54. Accordingly, the first plurality of hairs 6 may render the distal edge 39 less noticeable. While FIG. 8D shows only a single weft 4, in one embodiment, a plurality of wefts 4 may be attached to the second substrate like as shown in FIG. 8A. The hair extension 20 further includes attachment device 56 (e.g., a hair extension clip) to attach the hair extension 20 to the wearer's natural hair 18. The attachment device 56 is secured to the first substrate 8 on the top side 28 in a manner like that shown and described above in FIGS. 7 and 7A.

Figure 9:
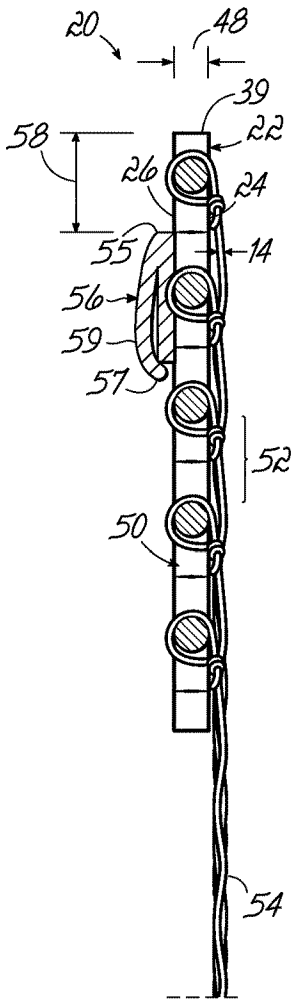
FIG. 9 is a cross-sectional view of another variation of the hair extension of FIG. 7 without any weft in accordance with another embodiment of the invention.

With reference now to FIG. 9, the hair extension 20 shown is another variation of the hair extension 20 of FIG. 7 in which the hair extension 20 is without any weft 4 at all. And while the second substrate 22 is shown to be a single layer, it is understood that other embodiments of the invention may include one or more layers of the second substrate 22 attached to each other (not shown). Similarly, while the second plurality of hairs 54 is shown to extend from the second substrate top side 24, other embodiments of the invention may attach a plurality of hairs to the other side of the second substrate 22, both sides of the second substrate 22, or neither side of the second substrate 22. The hair extension 20 further includes at least one attachment device 56 used to attach the hair extension 20 to the wearer or the wearer's natural hair 18. As shown in FIG. 9, the attachment device 56 is the hair extension clip 56, as previously discussed, and can be attached to the bottom side 26 of the second substrate 22 in a manner as shown and described above in FIGS. 7 and 7A.

Figure 10A:
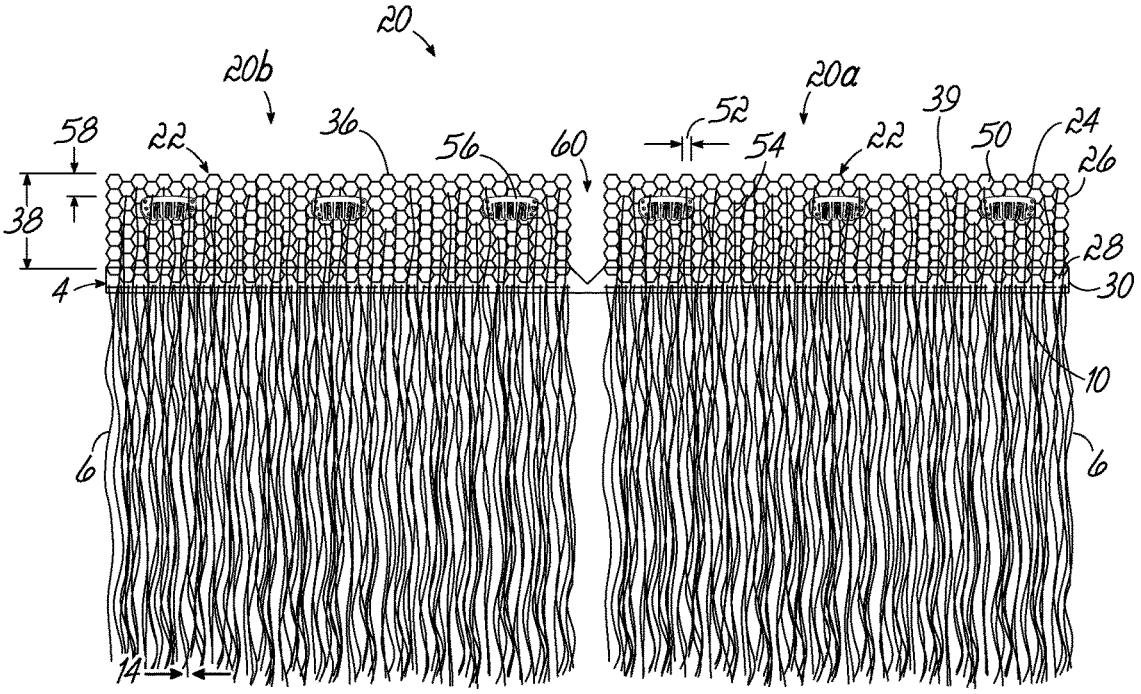
FIGS. 10A and 10B are back and front elevational views, respectively, of a hair extension with a notched opening in the second substrate in accordance with another embodiment of the invention.
Figure 10B:
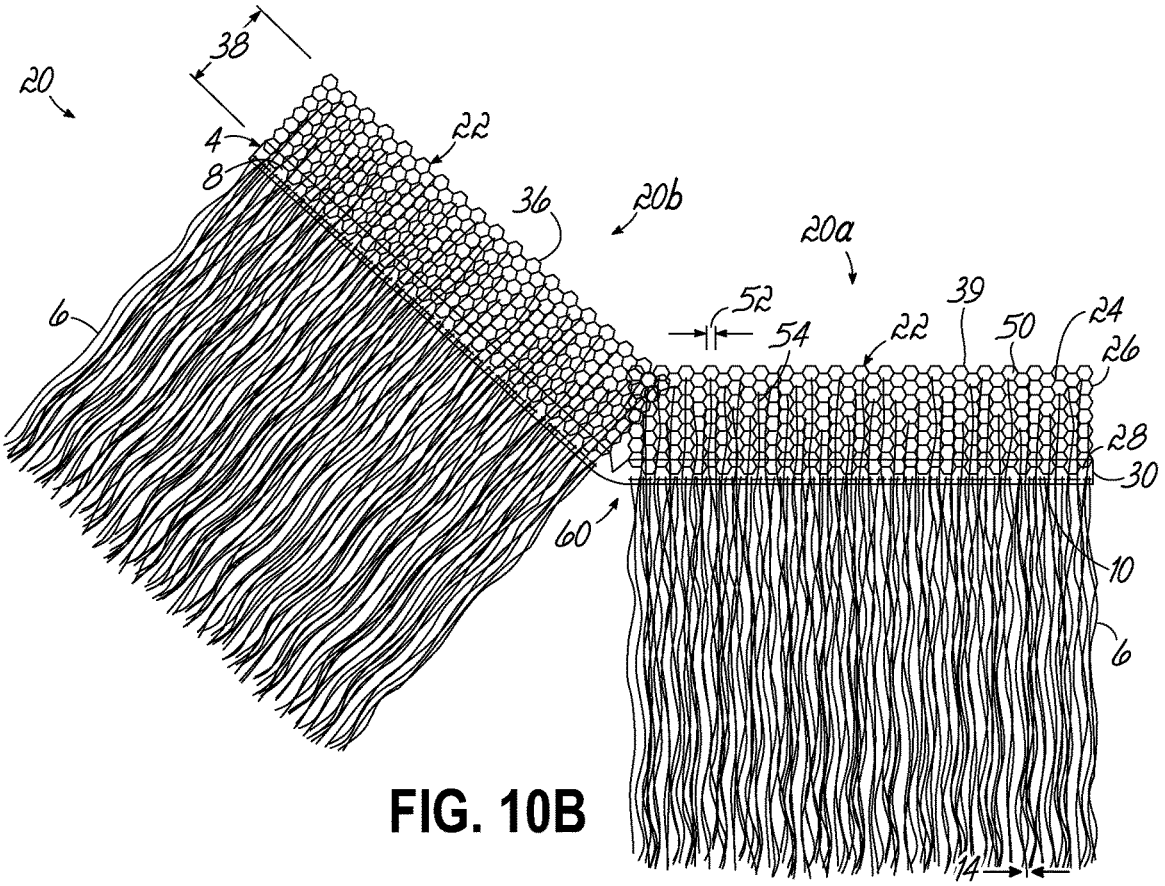

With reference to FIGS. 10A and 10B, the hair extension 20 is shown having a notched type opening or slit 60 (e.g., a v-shaped type notch) therein, such as within the first and second substrate 8, 22. This opening 60 may be made by cutting through or cutting out a section of the first and second substrate 8, 22 of the hair extension 20, thereby defining a first hair extension portion 20*a* on one side of the opening 60 and a second hair extension portion 20*b* on the other side of the opening 60. In one example, the opening 60 may stop short of or not extend into the first substrate 8. The size and/or shape of the opening 60 may be adjusted as needed or desired and more than one opening or slit 60 may be provided along the length of the hair extension 20, as needed. After the opening 60 is made, as best shown in FIG. 10B, the first hair extension portion 20*a* and the second hair extension portion 20*b* may be bent or adjusted at or to a desired angle relative to each other as shown, such as for situating about the part 16 of a wearer's hair. Here, the hair extension 20 remains as a single or connected piece despite being cut to form the single opening 60. However, it should be understood that the hair extension 20 also may be cut completely in half to separate the first hair extension portion 20*a* from the second hair extension portion 20*b* (not shown). In one embodiment, a desired length of the hair extension 20 may be packaged for sale for later cutting to a desired length for a desired end use. It should also be understood that a plurality of openings 60 may be created in the hair extension 20 to provide for or permit a plurality of portions and bend options.

With reference to FIGS. 11A-11E, a method is shown in which the wearer is preparing a part 16 in the wearer's natural hair 18 to receive the hair extension 20 of the present invention, as is further discussed in FIGS. 12A-12F below. While FIGS. 11A-11E are ordered alphabetically, the method of preparing a wearer's natural hair 18 may use a different ordering of steps, with one or more steps being optional and, thus, may be completely omitted from the method. As shown in FIG. 11A, the wearer straightens and defines hair part 16 in the desired location. While the hair part 16 is shown to be at the top crown of the wearer's head, it may be made in other locations as well such as, for example, a side of the wearer's head and/or the back of the wearer's head (See, e.g., FIG. 16). As shown in FIG. 11B, the wearer optionally may tease a first natural hair portion 18*a* at the roots to create a first tangle 62 adjacent to one side of the hair part 16. As shown in FIG. 11C, the wearer optionally may tease a second natural hair portion 18*b* at the roots to create a second tangle 64 adjacent to the other side of the hair part 16. With further reference to FIGS. 11B and 11C, the hair optionally may be teased to form the first tangle 62 and the second tangle 64 by using, for example, a comb, a brush, or other suitable hair manipulation tool. The first tangle 62 and the second tangle 64 may serve as anchors at which the hair extension 20 may be attached, such by way of the hair extension clip 56 (not shown). Another type of anchor includes, for example, an anchor braid 66 (see FIGS. 13-15), which optionally may be used as an anchor point as further described below. As shown in FIG. 11D, the wearer may move the first natural hair portion 18*a* out of the way and against the wearer's scalp. Although not shown, the same may be done with the second natural hair portion 18*b*. As shown in FIG. 11E, the wearer's natural hair 18 is prepared and ready to have one or more hair extensions 20 optionally attached to the first tangle 62 and/or the second tangle 64 as described further below. In the absence of the optional teasing steps, which produces the first and second tangles 62, 64, a user can simply secure the hair extension 20 to the hair, such as at the roots of the hair, adjacent to the prepared hair parts 16, such as via the hair extension clip(s) 56, as would be understood in the art, instead of to the first and second tangles 62, 64, for example. When preparing the hair part 16, the wearer may decide also to provide a leave out including a portion of the wearer's natural hair 18 proximate to the hair part 16 (not shown).

With reference to FIGS. 12A-12F, a method is shown in which the wearer attaches the hair extension 20 of the present invention (depicted here as first and second hair extensions 20*a* and 20*b*, which may be completely separated as shown, or attached together as discussed in FIGS. 10A and 10B) to the wearer's hair as prepared, for example, in FIGS. 11A-11E. While FIGS. 12A-12F are ordered alphabetically, the inventive method of preparing the wearer's natural hair 18 may use a different ordering of steps, with one or more steps being optional and, thus, may be completely omitted from the method.

Figure 12A:
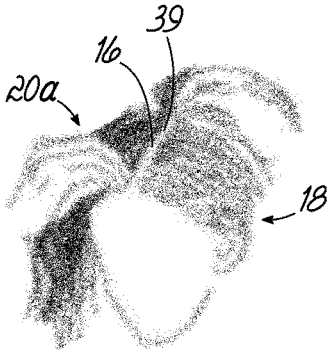
FIGS. 12A-12F are perspective views of the wearer attaching the hair extension of FIG. 6 to a wearer's hair as prepared in FIGS. 11A-11E in accordance with an embodiment of the invention.
Figure 12B:
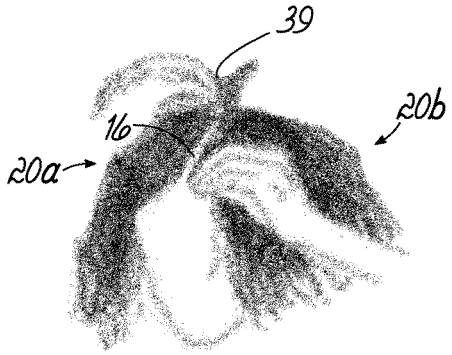
Figure 12C:
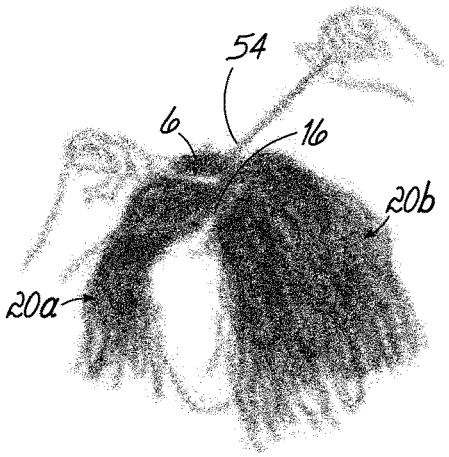
Figure 12D:
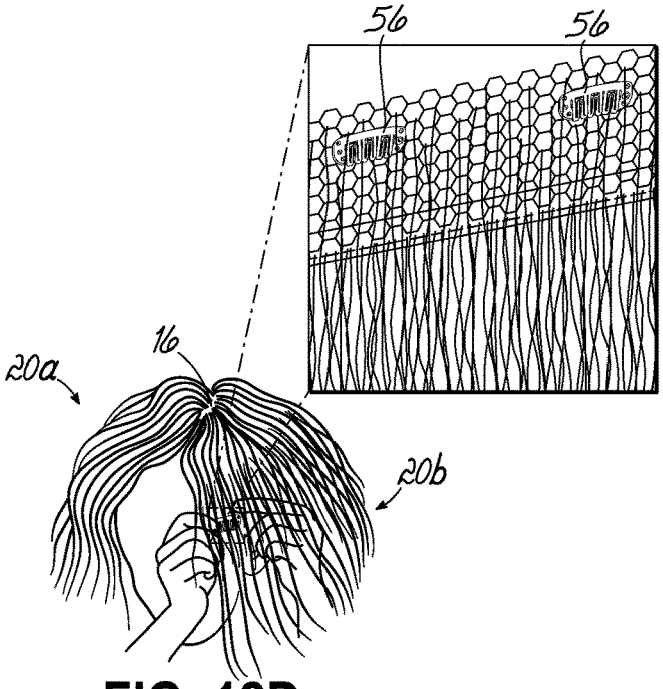
Figure 12E:
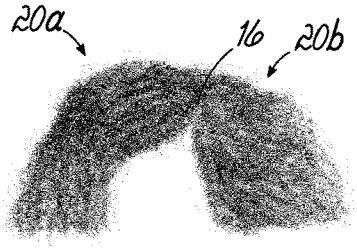
Figure 12F:
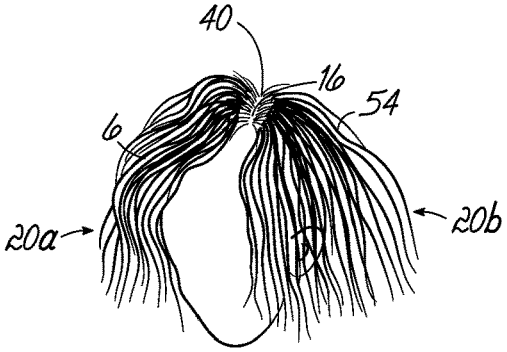

As shown in FIG. 12A, the wearer may position the distal edge 39 of the first hair extension 20*a* adjacent to one side of the hair part 16 and can attach the attachment device 56 (e.g., the hair extension clip 56) to the first tangle 62, if the first tangle 62 is created. In the absence of the first tangle 62, as indicated above, a user can simply secure the hair extension 20*a* to the hair, such as at the roots of the hair, adjacent to the prepared hair part 16, such as via the hair extension clip 56, as would be understood in the art. As shown in FIG. 12B, the wearer may position the distal edge 39 of the second hair extension 20*b* adjacent to the other side of the hair part 16 and can attach the attachment device 56 (e.g., the hair extension clip) to the second tangle 64, if the second tangle 64 is created. In the absence of the second tangle 62, as indicated above, a user can simply secure the hair extension 20*b* to the hair, such as at the roots of the hair, adjacent to the prepared hair part 16, such as via the hair extension clip 56, as would be understood in the art. With reference to FIGS. 12A and 12B, the attachment device 56 optionally may be attached to the first tangle 62 and second tangle 64 so that the wearer's natural hair 18 underneath is not visible while a portion of the wearer's scalp at the hair part 16 is visible. In another embodiment, the first tangle 62 and/or second tangle 64 may be replaced by an optional anchor braid 66 and the hair extension secured thereon or therebetween, for example, as further discussed below (See FIGS. 13-15). In methods where preparing the wearer's hair does not include defining the first tangle 62 and/or the second tangle 64, the attachment device 56 may be positioned adjacent to the hair part 16 so that the wearer's natural hair 18 is not visible while a portion of the wearer's scalp at the hair part is visible. As shown in FIG. 12C, the wearer may further tease the roots of at least one of the first plurality of hairs 6 and/or the second plurality of hairs 54 adjacent to the hair part 16. This may create lift or volume at the roots and may help to create a transition between the wearer's natural hair 18 and the hair extension 20*a*, 20*b* such that the hair extension 20*a*, 20*b* is less noticeable. In one embodiment, the hair extension 20*a*, 20*b* includes hairs processed to resemble the wearer's natural hair 18 at or proximate to the distal edge 39 (not shown). As depicted in FIG. 12D, the wearer may install the first hair extension 20*a* and/or the second hair extension 20*b* to the optional first tangle 62 and the second tangle 64 respectively using the attachment device 56, or can simply secure the hair extensions 20*a* and/or 20*b* to the hair, such as at the roots of the wearer's natural hair 18, adjacent to the prepared hair part 16, such as via the hair extension clip 56, as would be understood in the art. As shown in FIG. 12E, both the first hair extension 20*a* and the second hair extension 20*b* are attached to the wearer's natural hair 18. In FIG. 12F, a leave out 40 optionally can be prepared and can be blended into at least one of the first plurality of hairs 6 and/or the second plurality of hairs 54. The leave out 40 may be blended into the hair extension using means and methods know in the art.

Figure 13:
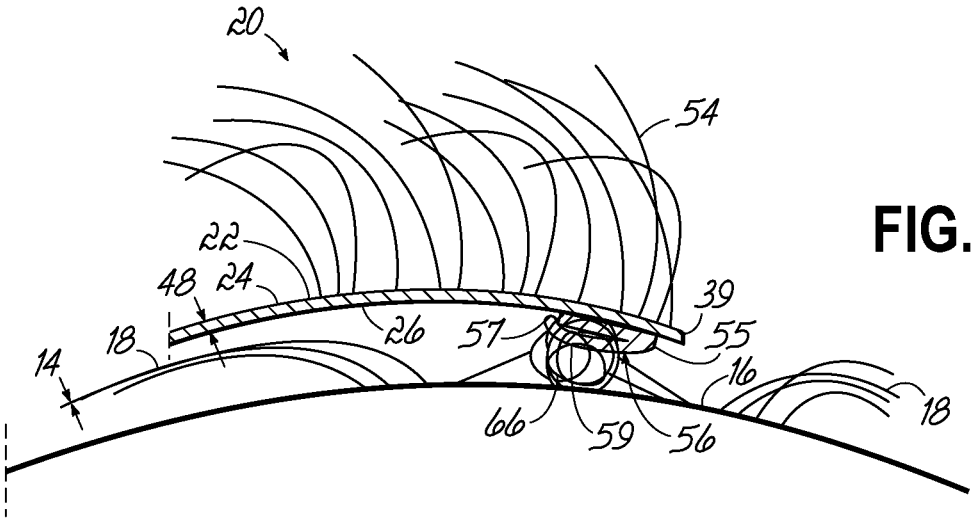
FIG. 13 is a partial cross-sectional view of a hair extension clip attached to an anchor braid separated from a wearer's part in accordance with an embodiment of the invention.
Figure 14:
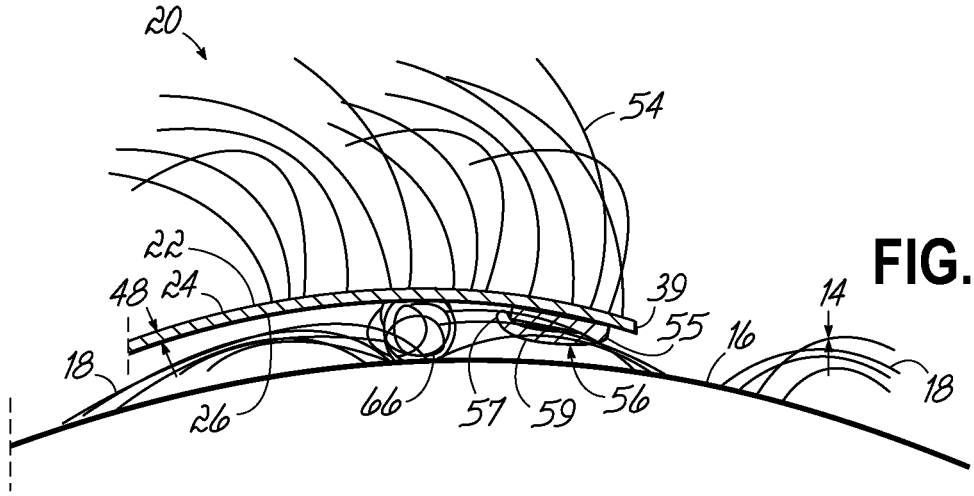
FIG. 14 is a partial cross-sectional view of a hair extension clip attached to a plurality of natural hairs between the wearer's part and an anchor braid in accordance with an embodiment of the invention.
Figure 15:
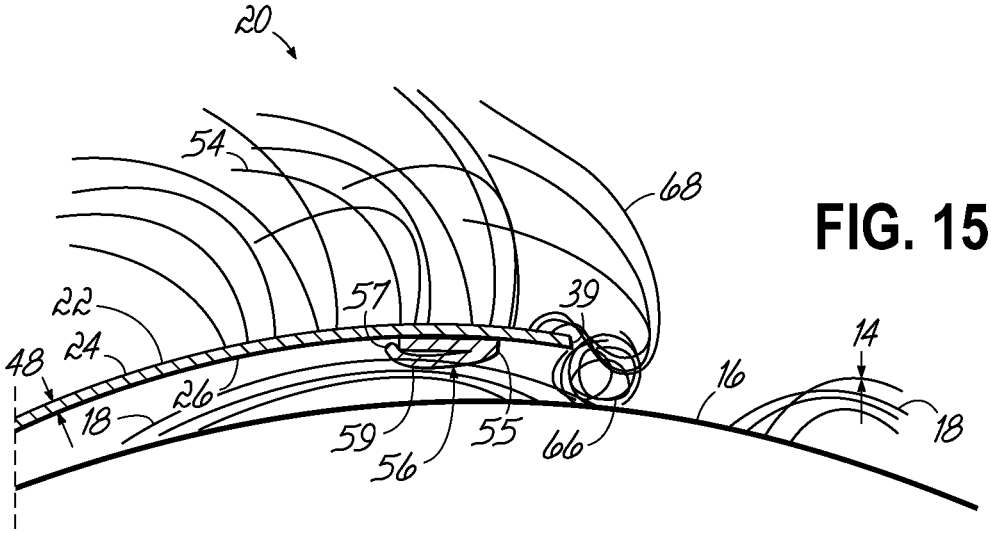
FIG. 15 is a partial cross-sectional view of a hair extension clip attached to an anchor braid adjacent to the wearer's part in accordance with one embodiment of the invention.

With reference now to FIGS. 13-15, the hair extension 20 may be attached to the wearer's natural hair 18 at or proximate to anchor braid 66 instead of the first tangle 62 and/or the second tangle 64. While the anchor braid 66 is shown to be on one side of the hair part 16, in one embodiment, the anchor braid 66 may be situated on the other side of the hair part 16 or on both sides of the hair part 16. Moreover, while the weft 4 is not illustrated here, as would be understood, one or more wefts 4 may be attached to the second substrate 22 such that the first plurality of hairs 6 extends in a direction away from the hair part 16.

With specific reference to FIG. 13, the attachment device 56, e.g., the hair extension clip, can be attached directly to the anchor braid 66. And with reference to FIG. 14, the anchor braid 66 is spaced apart/spaced further apart from the hair part 16. The attachment device 56 can be attached to the wearer's natural hair 18 between the hair part 16 and the anchor braid 66. In this configuration, the anchor braid 66 acts as a stop that prevents lateral movement of the hair extension 20 while worn. In this embodiment, the second plurality of hairs 54 proximate to the distal edge 39 can be straight hair whereby the hair extension 20 can be less noticeable at least because it may blend in better with the wearer's natural hair 18 adjacent to the hair part 16.

In FIG. 15, the anchor braid 66 is now shown positioned between the hair extension 20 and the hair part 16. In this embodiment, the attachment device 56 is attached to the wearer's natural hair 18 but now adjacent to the anchor braid 66. In addition and as further shown, the hair extension 20 also can be attached to the anchor braid 66 using a portion of the second plurality of hairs 54 proximate to the distal edge 39, a plurality of crocheted hairs 68, such as by crocheting those hairs through the anchor braid 66 and optionally further by wrapping the hairs over the anchor braid 66 and hair extension 20. Other methods for joining together thread-like materials such as, but not limited to, tying, sewing, or other suitable techniques may also be used to attach the plurality of crocheted hairs 68 to the anchor braid 66. This crocheting attachment method serves to both attach the hair extension 20 to the wearer's natural hair 18 and also make the hair extension 20 less noticeable. In one embodiment, the hair extension 20 does not include the attachment device 56, as shown, and is attached instead to the hair extension 20 using only the plurality of crocheted hairs 68.

Figure 16:
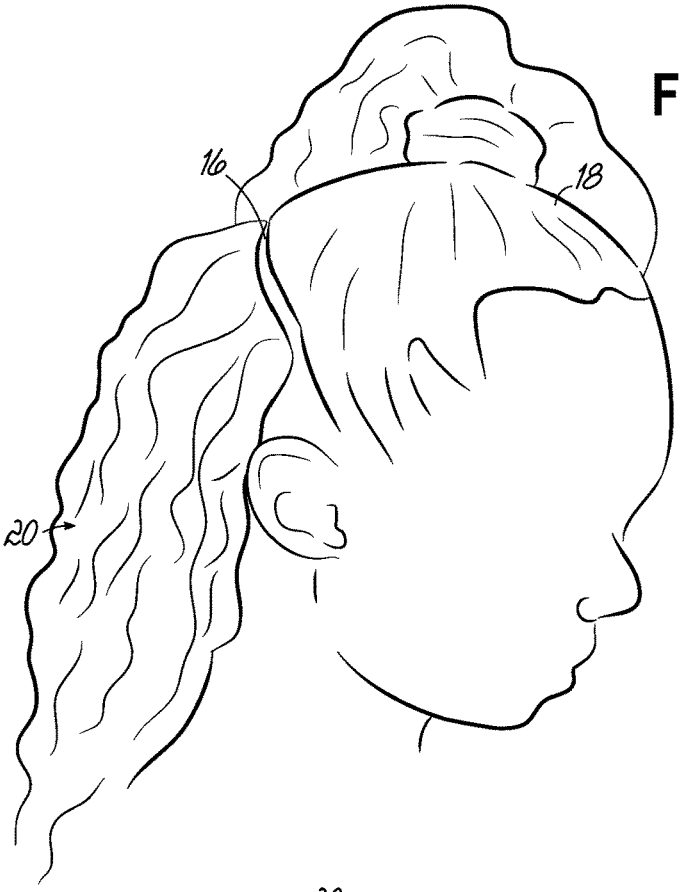
FIG. 16 is a perspective view of a wearer using the hair extension of FIG. 6 in a half-up half-down hairstyle in accordance with an embodiment of the invention.

With reference now to FIG. 16, the hair part 16 may be located on the side and/or back of a wearer's head. As shown, the horizontal hair part 16 situates a portion of the wearer's natural hair 18 upwards and another portion of the wearer's natural hair 18 downwards. Providing the hair part 16 on the side and back of the wearer's hair in this manner allows for additional hair styles, such as the "half-up half-down" hair style as is shown here. It should be understood that the wearer may choose to define a hair part 16 in any desired location. The hair extension 20 may be attached to the hair part 16 shown here in a similar manner as just described above in FIGS. 12A-12E on the side and back of the wearer's head with this "half-up half-down" hairstyle. But instead of attaching hair extensions 20 adjacent to both sides of the hair part 16, one hair extension 20 is attached adjacent to the bottom side of the hair part 16. With this style, the wearer may choose to wear the upper portion of their natural hair 18 up in a ponytail, braid, bun, or some other up-do or, alternatively, in another embodiment, the half-up portion may be left down altogether. In addition, with this half-up half-down hairstyle or when the half-up portion is left down altogether, multiple spaced-apart horizontal parts (not shown) may be prepared up and/or down the back and/or side of the head for use with additional hair extensions 20. In such embodiments, the wearer's natural hair 18 may be left out between at least one of the multiple spaced-apart horizontal parts 16/installed hair extensions 20 (not shown). For example, the wearer may use multiple hair extensions 20 such that between each hair extension 20 a portion of the wearer's natural hair 18 is left out, creating a pattern of alternating layers of hair extensions 20 and the wearer's natural hair 18. Moreover, since upper layers will cover and obscure the appearance of lower layers thereby providing overlapping layers of hair, other examples may only include a single hair extension 20 in accordance with the present invention as the topmost layer of hair adjacent to the topmost part, for example, while other lower layers of hair can define conventional hair extensions 2 (not shown).

Figure 17:
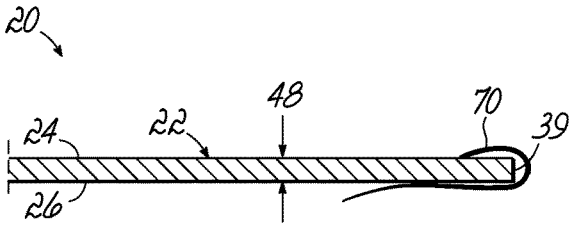
FIG. 17 is a cross-sectional view of a fold-over hair extension in accordance with an embodiment of the invention.
Figure 18:
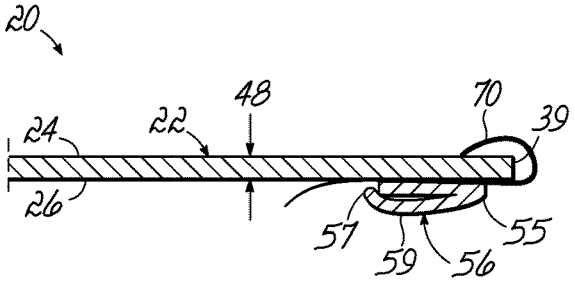
FIG. 18 is a cross-sectional view of a variation of the fold-over hair extension of FIG. 17 in accordance with another embodiment of the invention.
Figure 19:
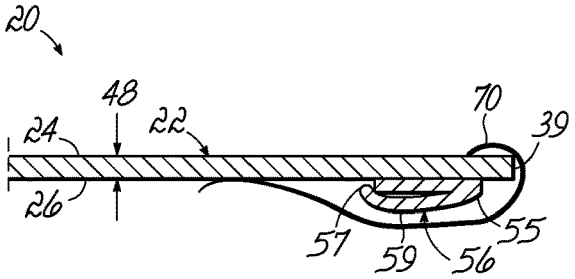
FIG. 19 is a cross-sectional view of another variation of the fold-over hair extension of FIG. 17 in accordance with another embodiment of the invention.

With reference to FIGS. 17-19, a portion of the second plurality of hairs 54 proximate to the distal edge 39 may be used to define a wrap-around hair portion 70 that is folded over or wrapped around the distal edge 39 of the second substrate 22 in an effort to make the hair extension 20 less noticeable when worn. The wrap-around hair portion 70 may then be wedged under or against or attached/secured to the second substrate 22 at the second substrate bottom side 26. Although not specifically depicted, in one embodiment, one or more wefts 4 may be attached to the second substrate 22 opposite the distal edge 39. In such embodiments, the wrap-around hair portion 70 may be wedged under or against or attached/secured to the hair extension 20 at the first substrate bottom side 30. The wrap-around hair portion 70 may be attached to the hair extension 20 using means and methods known in the art including, for example, bonding with an adhesive (e.g., glue), taping, sewing, and the like.

With specific reference to FIG. 17, the hair extension 20 includes the wrap-around portion 70 but excludes any attachment device 56. In FIG. 18, the hair extension 20 includes the wrap-around portion 70 but is folded over or wraps around the distal edge 39 and is further sandwiched or securely situated between the second substrate bottom side 26 and the attachment device 56. And in FIG. 19, the hair extension 20 includes the wrap-around portion 70 but here is folded over or wraps around both the distal edge 39 and the attachment device 56. In one embodiment, the attachment device 56 (e.g., the hair extension clip) is used to secure the wrap-around portion 70 instead of or in addition to attaching the wrap-around portion 70 to the hair extension 20 itself. With further reference to FIGS. 18 and 19 in one embodiment, a portion of the second substrate 22 proximate to the distal edge 39 can be wrapped around the attachment device 56 (not shown). The portion of the second substrate 22 wrapped around the attachment device 56 may be attached thereto using, for example, an adhesive (e.g., glue or tape) or other suitable methods and the like.

Figure 20:
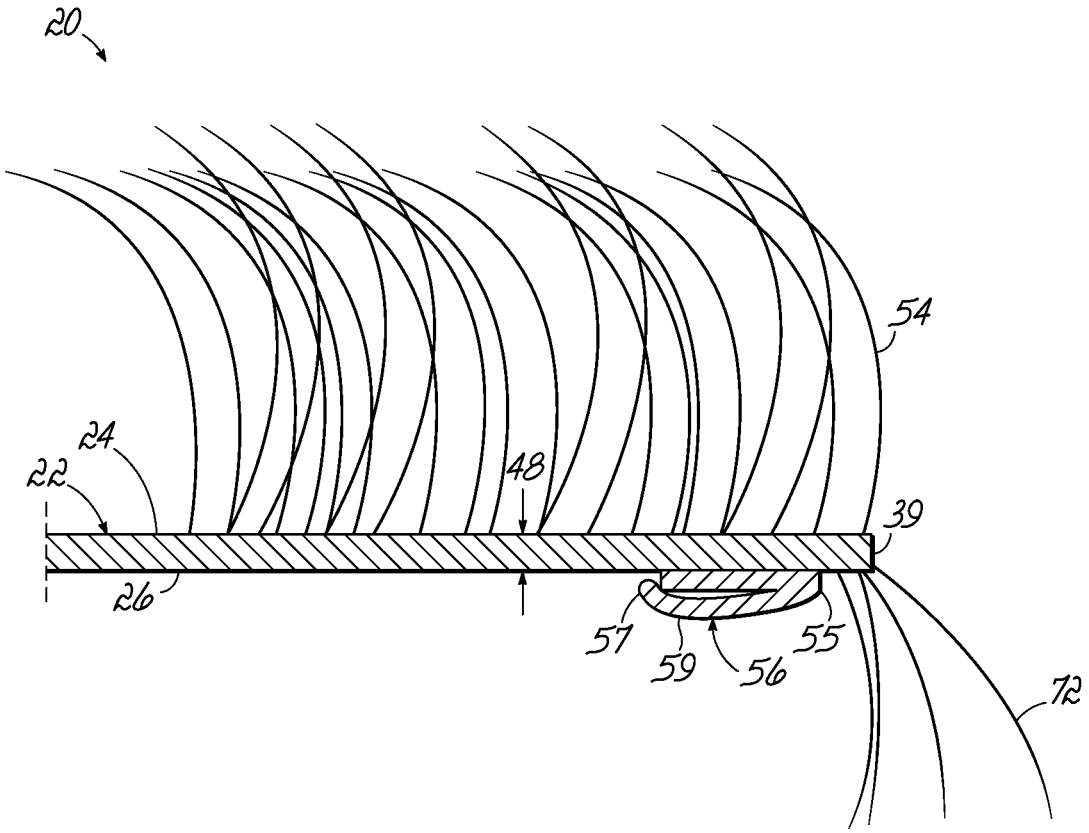
FIG. 20 is a cross-sectional view of yet another variation of the fold-over hair extension of FIG. 17 in accordance with another embodiment of the invention.

With reference to FIG. 20, the hair extension 20 includes a third plurality of hairs 72 attached to the second substrate bottom side 26. In one embodiment, the third plurality of hairs 72 is proximate to the distal edge 39. The third plurality of hairs 72 may be attached to the second substrate 22 using means and methods know in the art including, for example, hand tying, crocheting, ventilating, or other similar methods and the like. The third plurality of hairs 72 may be situated on or wrapped around the distal edge 39 to cover or blend in with the second plurality of hairs 54, making the second substrate 22 and the hair extension 20 less noticeable.

The characteristics of the third plurality of hairs 72 may be selected based on at least one of several considerations, which may be the same as the first and/or second plurality of hairs 6, 54. For example, the third plurality of hairs 72 may include the same or different types of hair such as natural hair, synthetic hair, other suitable hair replacements, or a combination thereof. The third plurality of hairs 72 may also have the same or different characteristics such as straight, wavy, curly, frizzy, kinky, other suitable hair types, or combinations thereof. The color of the third plurality of hairs 72 may be selected, for example, to correspond with the color of second substrate 22, the color of the first and/or second plurality of hairs 6, 54, or the color of the wearer's natural hair 18. In one example, the color selected can be black, jet black, natural black, and the like. In one embodiment, the third plurality of hairs 72 includes hair with different characteristics that are attached to different portions of the second substrate 22. In one embodiment, the third plurality of hairs 72 includes hair with different characteristics that are attached to different portions of the second substrate 22. In another embodiment, some of the third plurality of hairs 72 attached to the second substrate 22 are frizzy, kinky, curly, or are processed in some other similar style while other portions of the third plurality of hairs 72 have a different style. For example, the third plurality of hairs 72 proximate to the distal edge 39 may be frizzy, kinky, or curly to obscure the distal edge 39 while other portions of the third plurality of hairs 72 have the characteristics of the desired hairstyle.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method and illustrative example shown and described. Accordingly, departures may be made from such details without departing from the spirit or scope of applicant's general inventive concept.

What is claimed is:

1. A hair extension comprising:

a first weft including a first substrate and a first plurality of hairs, the first substrate having a length, width, and thickness and including a top side, a bottom side opposite the top side, and an edge along the length of the first substrate, the first plurality of hairs having a desired length and extending from the top side, wherein the bottom side is situated proximate a wearer's hair when the hair extension is attached to the wearer's hair;

a second substrate having a length, width, and thickness and including a top side and a bottom side opposite the top side, the second substrate being attached to the first substrate at or along the edge of the first substrate so that the second substrate extends in a direction generally opposite to the first substrate, the bottom side of the second substrate is situated proximate the wearer's hair when the hair extension is attached to the wearer's hair;

a second plurality of hairs having a desired length and extending from the top side of the second substrate; and an attachment device coupled to the bottom side of the second substrate, the attachment device configured to engage with the wearer's hair for securing the hair extension to the wearer's hair, wherein the first substrate and the second substrate are different.

2. The hair extension of claim 1 further comprising a second attachment device coupled to the bottom side of the first substrate.

3. The hair extension of claim 2 wherein the attachment device and the second attachment device are a hair clip or comb.

4. The hair extension of claim 1 wherein the second substrate is attached to the first substrate at one or more locations along the length of the first and second substrate and adjacent the edge of the first substrate to define an overlap.

5. The hair extension of claim 1 wherein the second substrate comprises or mesh material defining a plurality of openings.

6. The hair extension of claim 5 wherein the second substrate comprises a lace.

7. The hair extension of claim 6 wherein the second plurality of hairs are secured to the second substrate via corresponding openings in the lace of the second substrate.

8. The hair extension of claim 1, wherein the second substrate comprises a sheet of a synthetic material.

9. The hair extension of claim 8, wherein the second substrate comprises a polyurethane sheet.

10. The hair extension of claim 1, wherein the thickness of the second substrate is less than the thickness of the first substrate and the width of the second substrate is greater than the first substrate.

11. The hair extension of claim 10, wherein the length of the first and second substrates are generally the same.

12. The hair extension of claim 1 further comprising a third substrate having a length, width, and thickness and including a top side and a bottom side opposite the top side, the third substrate being attached to the first substrate at or along the edge of the first substrate opposite the second substrate so that the third substrate extends in a direction generally opposite to the first substrate and in generally parallel relation with the second substrate, the bottom side of the third substrate is situated proximate the wearer's hair when the hair extension is attached to the wearer's hair, wherein the first substrate and the third substrate are different.

13. The hair extension of claim 12 further comprising a third plurality of hairs having a desired length and extending from the bottom side of the third substrate.

14. The hair extension of claim 1 further comprising one or more additional wefts that securely cooperate with the first substrate of the first weft such that the one or more additional wefts extend in a direction away from the second substrate, the one or more additional wefts including a plurality of hairs having a desired length that extend from the one or more additional wefts, the one or more additional wefts being similarly configured and oriented as the first weft.

15. The hair extension of claim 1 wherein the second substrate is folded over the first weft to sandwich the first weft therebetween, the second substrate being attached to the top and bottom sides of the first substrate along opposing edges of the second substrate and at or along the edge of the first substrate so that the second substrate extends in a direction generally opposite to the first substrate, the top side of the second substrate is situated proximate the wearer's hair when the hair extension is attached to the wearer's hair.

16. The hair extension of claim 1 wherein a portion of the second plurality of hairs proximate a distal edge of the second substrate, which is opposite the edge at or along which the second substrate is attached to the first substrate, defines a wrap-around hair portion that can be folded over the distal edge.

17. The hair extension of claim 1 wherein the second substrate further comprises a third plurality of hairs having a desired length and extending from the bottom side of the second substrate proximate a distal edge thereof, which is opposite the edge at or along which the second substrate is attached to the first substrate, wherein a portion of the third plurality of hairs defines a wrap-around hair portion that can be folded over the distal edge.

18. The hair extension of claim 1 wherein the first and second plurality of hairs extend in substantially the same direction.

19. The hair extension of claim 1 wherein a color of at least one of the first substrate, the second substrate, the first plurality of hairs, or the second plurality of hairs is selected from black, jet black, or natural black.

20. The hair extension of claim 1 wherein the first substrate, the second substrate, the first plurality of hairs, and the second plurality of hairs are black in color.

* * * * *